US009163478B2

(12) United States Patent
Broussard et al.

(10) Patent No.: US 9,163,478 B2
(45) Date of Patent: Oct. 20, 2015

(54) INWARDLY SWELLING SEAL

(71) Applicant: Weatherford/Lamb, Inc., Houston, TX (US)

(72) Inventors: John P. Broussard, Kingwood, TX (US); Christopher A. Hall, Cypress, TX (US); Patrick J. Zimmerman, Houston, TX (US); Glen Robitaille, North Vancouver (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 427 days.

(21) Appl. No.: 13/661,878

(22) Filed: Oct. 26, 2012

(65) Prior Publication Data

US 2014/0116678 A1 May 1, 2014

(51) Int. Cl.

| | |
|---|---|
| ***E21B 33/13*** | (2006.01) |
| ***E21B 33/12*** | (2006.01) |
| *E21B 43/04* | (2006.01) |

(52) U.S. Cl.

CPC ..... *E21B 33/13* (2013.01); *E21B 33/1208* (2013.01); *E21B 43/04* (2013.01)

(58) Field of Classification Search

CPC ..... E21B 43/04; E21B 43/10

See application file for complete search history.

(56) References Cited

U.S. PATENT DOCUMENTS

| | | | | |
|---|---|---|---|---|
| 4,936,386 | A * | 6/1990 | Colangelo | 166/292 |
| 2006/0272806 | A1 | 12/2006 | Wilkie et al. | |
| 2011/0056706 | A1 | 3/2011 | Brooks | |
| 2011/0120733 | A1 | 5/2011 | Vaidya et al. | |
| 2012/0006569 | A1 | 1/2012 | Smith et al. | |

FOREIGN PATENT DOCUMENTS

| | | | |
|---|---|---|---|
| GB | 2448069 | A | 10/2008 |
| WO | 2008062186 | A1 | 5/2008 |
| WO | 2009074785 | A2 | 6/2009 |

OTHER PUBLICATIONS

"Swellable packers to automatically choke or shut of flow in a wellbore," IP.Com Journal, IP.Com Inc., West Henrietta, NY, US, Dec. 7, 2010, XP013142917, ISSN: 1533-0001.

Extended Search Report received in corresponding EP Application No. 13190255.3, dated Jan. 30, 2014.

* cited by examiner

*Primary Examiner* — Kenneth L Thompson
*Assistant Examiner* — Steven MacDonald
(74) *Attorney, Agent, or Firm* — Blank Rome, LLP

(57) ABSTRACT

A device and method that allows a gravel slurry to placed in a wellbore from the toe towards the heel to reduce the pressure acting upon the heel of the wellbore during the gravel placement operation. By reducing the pressure acting upon the heel gravel slurry may be placed in longer sections of the wellbore in a single operation.

24 Claims, 6 Drawing Sheets

INWARDLY SWELLING SEAL

BACKGROUND

Hydrocarbon wells, horizontal wells in particular, may have sections of wellscreens having a perforated inner tube with an overlying screen portion. The purpose of the screen is to block the flow of particulate matter into the interior of the production tubing. Despite the wellscreen, some contaminants and other particulate matter may continue to enter the production tubing. The particulate matter usually occurs naturally or is part of the drilling and production process. As the production fluids are recovered the particulate matter is also recovered at the surface. The particulate matter causes a number of problems in that the material may be abrasive or hazardous to the environment, thereby reducing the life of any associated production equipment and creating a disposal problem. By controlling and reducing the amount of particulate matter that is pumped to the surface, overall production costs are reduced.

Even though the particulate matter may be too large to enter the production tubing, the particulate matter may cause problems at the downhole wellscreens. As the well fluids are produced the larger particulate matter is trapped in the filter element of the wellscreens. Over the life of the well, as more and more particulate matter is trapped in the filter elements, the filter elements become clogged and restrict flow of the well fluids to the surface.

A method of reducing the inflow of particulate matter before it reaches the wellscreens is to pack gravel or sand in the annular area between the wellscreen and the wellbore. Packing gravel or sand in the annulus provides the producing formation with a stabilizing force to prevent any material around the annulus from collapsing creating additional particulate matter, it also provides a pre-filter to stop the flow of particulate matter before it reaches the wellscreen.

In a typical toe to heel gravel packing operation a screen and packer are run into the wellbore together. Once the screens and packer are properly located the packer is set so that it forms a seal between wellbore and the screen isolating the region above the packer from the region below the packer. The screen is also attached to the packer so that it hangs down in the wellbore forming an annular region around the exterior portion of the screen. At the bottom of the screen is a section of tubular that is blank but for the presence of gravel pack ports. The upper end of the screen is usually referred to as the heel and the lower end of the screen is usually referred to as the toe of the well.

Typically a washpipe subassembly is put together on the surface and then run into the wellbore where it stings through the packer and then run into the screen. The run in continues until the washpipe outlets are approximately aligned with the gravel pack ports in the blank section of tubular past the screens and near the toe of the well.

Once the washpipe is landed, a slurry, usually containing gravel, may be pumped down the well through the washpipe. When the gravel slurry reaches the outlets in the washpipe it exits the washpipe. The blank section of tubular may have an internal seal to help direct the gravel slurry through the gravel pack ports in the blank tubular and finally the gravel slurry flows into the packer and into the annular space created on the outside of the screen.

As the slurry travels from the toe of the well toward the heel along the outside of the screen, an alpha wave begins that deposits gravel from the toe towards the heel, all the while the transport fluid that carries the gravel drains to the inside of the screen. As the fluid drains into the interior of the screen it becomes increasingly difficult to pump the slurry down the wellbore. Once a certain portion of the screen is covered the gravel will start building back from the heel towards the toe, the beta wave, to completely pack off the screen.

After the annular area around the screen has been packed with gravel then the operator begin to reverse out. In some instances the operator may desire to backwash the interior of the screen to remove and excess gravel that may have been deposited in the interior of the screen assembly. In this case the ports in the washpipe that were depositing the sand slurry into the annulus are now raised above the internal seal and the operator pumps gravel free fluid down the annular area around the exterior of the washpipe to reverse the fluid inside of the washpipe back to surface thereby removing any the excess sand or gravel but leaving the gravel that was placed around the exterior of the screen in place.

SUMMARY OF THE INVENTION

A disadvantage of the system described above is that the gravel pack ports in the blank tubular must be sealed to prevent fluid and particulate matter, or even the gravel that was packed around the annulus, from flowing into the interior of the screen assembly through the gravel pack ports thereby and bypassing the screen altogether. Typically this is done by running in a packer or plug in the interior of the blank tubular to completely seal the portion of the tubular below the packer form the portion of the tubular above the packer preventing any fluid flow through the gravel pack ports into the interior of the screen assembly. A separate trip to run in and set such packer wastes rig time and costs money.

In the new system the packer attached to the interior of the blank tubular is constructed of a swellable material where the material either does not swell or swells only a minimal amount until either a predetermined time or condition exists in the wellbore. By running the swellable packer into the wellbore in the first condition where it has a smaller diameter the swellable packer may be used to seal against the washpipe during the gravel packing operation but then after the washpipe is removed the swellable seal is allowed to swell until it ultimately completely seals the interior of the blank tubular isolating the interior portion of the tubular below the swellable packer from the interior portion of the tubular above the packer. By sealing the interior of the blank tubular fluid and particulate matter is prevented from entering the interior of the screen assembly and flowing to the surface.

In other embodiments a swellable material attached to the interior of a could be used anytime where a seal needs to allow a tubular, mandrel, or any object to pass by the swellable seal for some period of time before the swellable seal is required to form a more robust seal against the tubular, mandrel, other object, or even to seal the interior of the tubular where the seal is placed.

Such a seal is particularly useful in those instances where a tightly fitting seal could be damaged by another object touching the seal thereby eroding the seal prior to the seal's function being required. A similar condition may be caused if the seal is placed on the exterior of a tubular or other object and then that tubular or object is moved a distance such as when a tubular is run into a wellbore. The contact between the seal and the wall of the well may damage the seal prior to the seal's function being required.

DETAILED DESCRIPTION OF EMBODIMENT(S)

Figure 1:
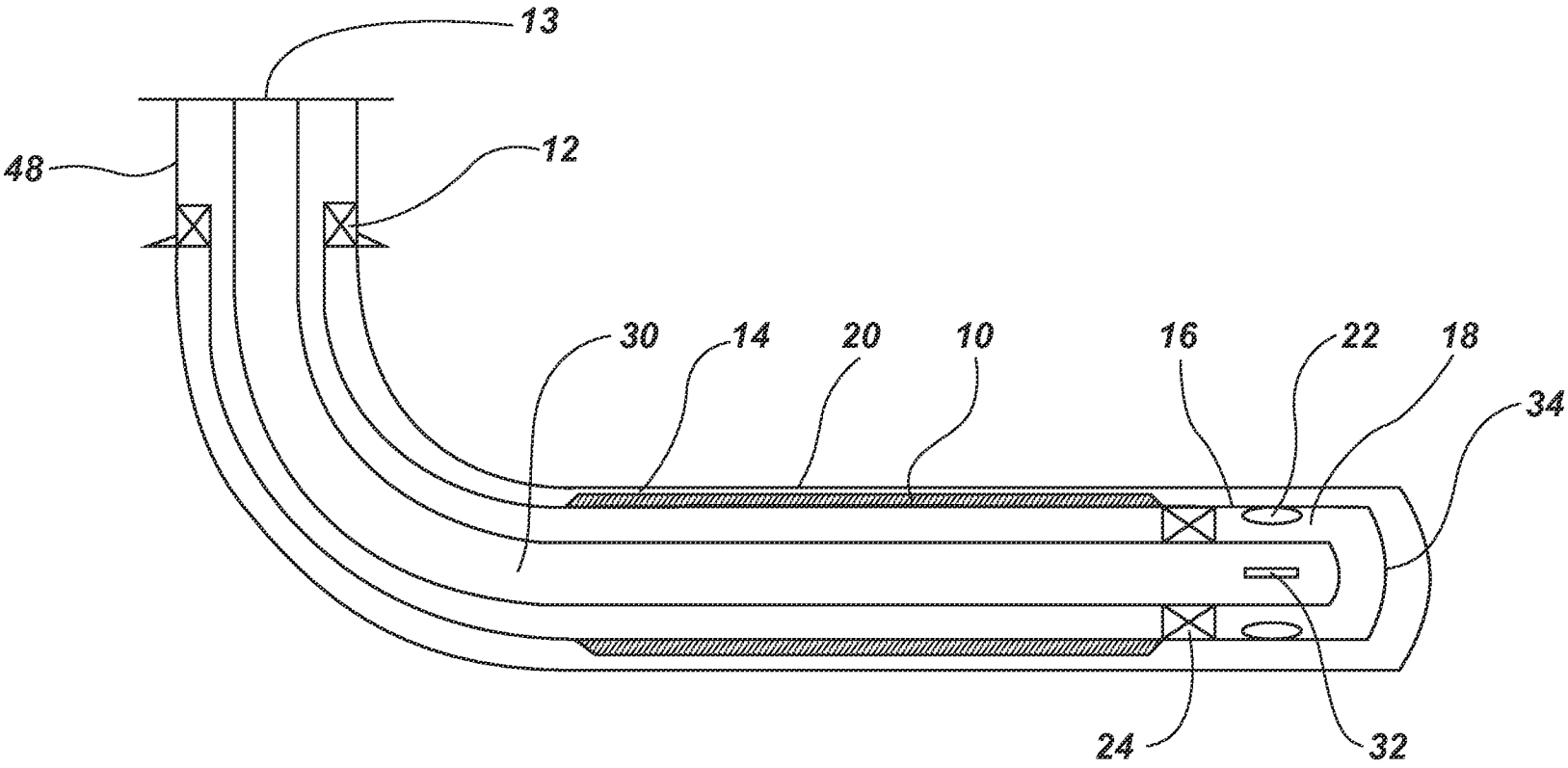
FIG. 1 depicts the washpipe after it has been run into the wellbore.

FIG. 1 depicts a packer 12 and screen assembly 10 that have been run from the surface 13 into the wellbore 20. The packer 12 is set so that the packer 12 seals the wellbore 20 to the screen assembly 10 and the screen assembly 10 forms an annular region 14 between the screen assembly's 10 exterior and the wellbore 20. The lower end, or toe, 16 of the screen assembly 10, has a section of pipe 18 that is blank but for the presence of gravel pack ports 22 with a float shoe 34 to seal the lower end of the screen assembly 10. The screen assembly has a packer element 24 attached to the interior of the blank section of pipe 18. The packer element 24 may be made of a swellable material that swells in the presence of water, hydrocarbons, or a hybrid fluid. The hybrid fluid may be a mixture of water and a hydrocarbon or other chemical additive to promote the expansion of the swellable material.

FIG. 1 also shows the washpipe 30 after it has been run into the wellbore 20 through the interior of the screen assembly 10. The washpipe 30 is run through the interior of the screen assembly 10 and before the packer 24 swells the washpipe 30 stings through the packer 24. The washpipe continues to run in to the wellbore until the port 32 is adjacent to the gravel pack ports 22.

Figure 2:
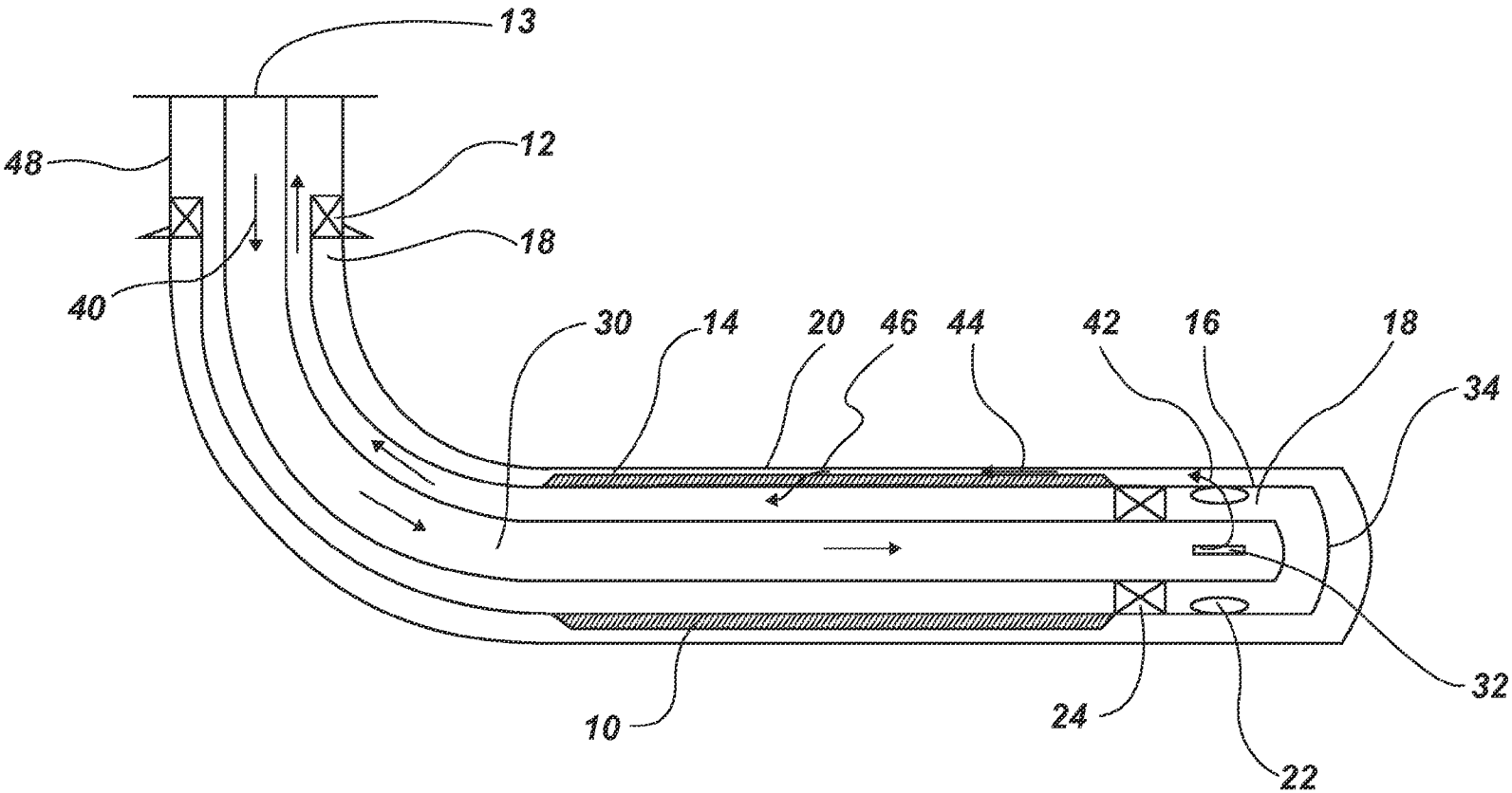
FIG. 2 depicts the screen assembly and the washpipe in place in the wellbore during the gravel pack operation.

FIG. 2 depicts the screen assembly 10 and the washpipe 30 in place in the wellbore 20 with the gravel slurry moving down through the washpipe as indicated by direction arrow 40. As the gravel slurry reaches the toe of the washpipe 30 the gravel slurry exits the washpipe 30 through port 32. After the gravel slurry exits the washpipe 30 the gravel slurry is prevented from traveling upward through the interior of the screen assembly by the swellable packer 24 and is prevented from exiting the bottom of the screen assembly 10 by the float shoe 34. As indicated by directional arrow 42, the gravel slurry is forced to exit the screen assembly 10 through the gravel pack ports 22 near the toe of the wellbore 20.

After exiting the gravel pack ports 22 the gravel slurry takes the path of least resistance and flows towards the heel of the wellbore 20 as indicated by directional arrow 44. As the gravel slurry moves upward towards the heel of the well along the exterior of the screen assembly 10 the fluid portion of the gravel slurry flows through the screen assembly 10 into the interior of the screen assembly 10 as indicated by directional arrow 46. When the fluid flows into the interior of the screen assembly 10 the gravel is deposited or "packed" around the exterior of the screen assembly 10. The fluid continues upward through the annular area between at first the screen assembly 10 then closer to the surface the casing 48 and the washpipe 30.

Figure 3:
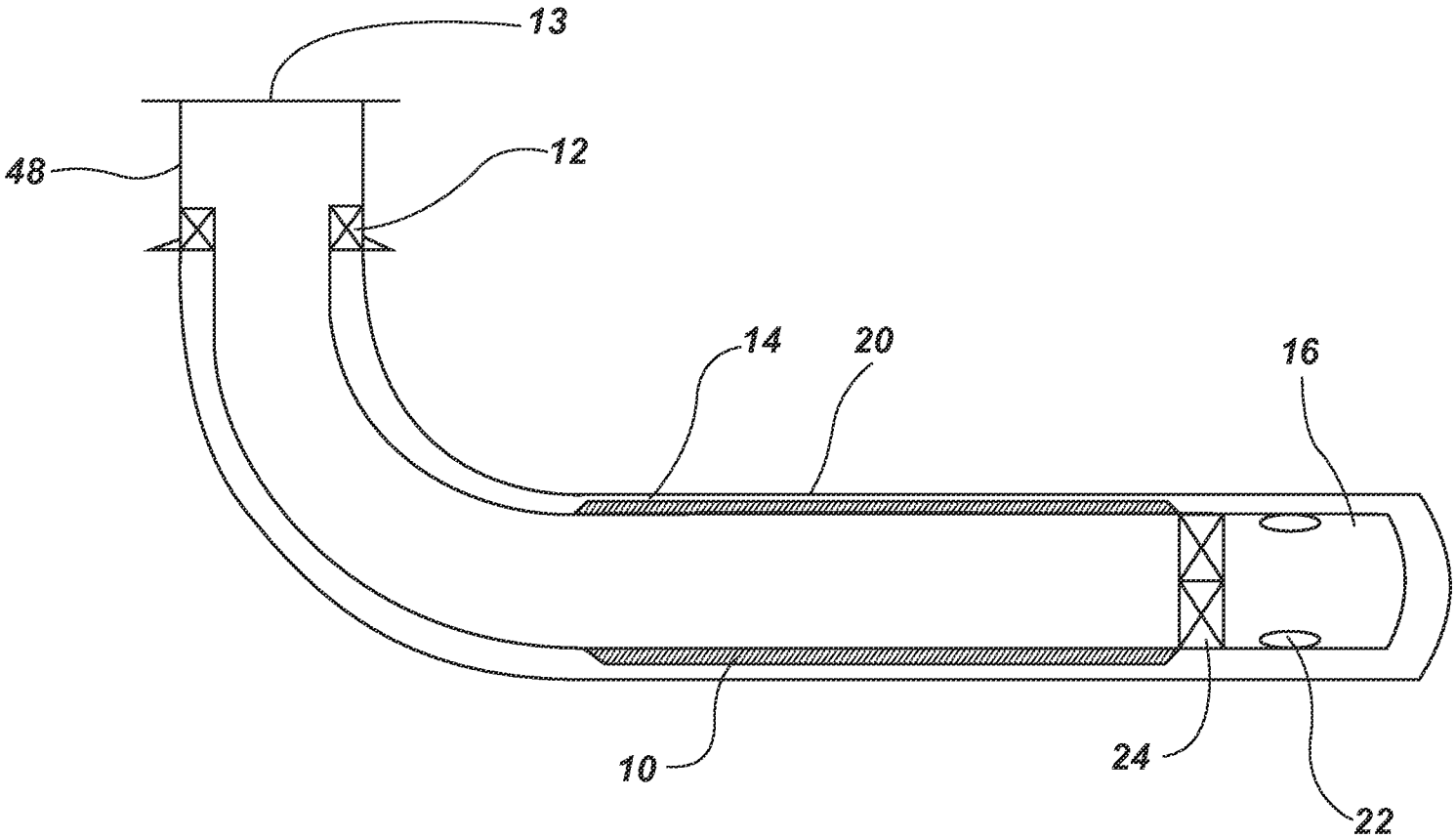
FIG. 3 depicts the swellable packer after it has expanded to seal the interior of the screen assembly.

After the gravel packing operation is complete the washpipe 30 is removed from the wellbore 20. As depicted in FIG. 3 the swellable packer 24 has expanded to seal the interior of the screen assembly 20 past the toe of the screen assembly 20. When the swellable packer 24 has fully expanded the well is ready to start production.

Figure 4:
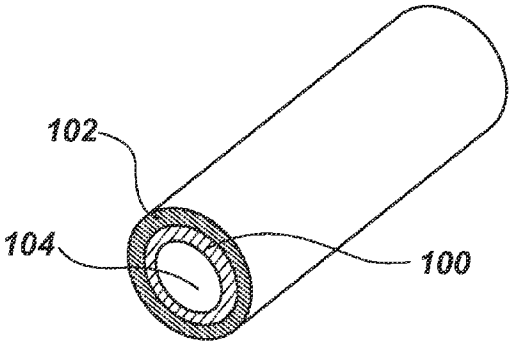
FIG. 4 depicts the swellable material in its initial condition attached to the inner circumference of the tubular.

There are multiple embodiments of a swellable seal or packer. The swellable material 100 depicted in FIG. 4 is shown in its initial condition. The swellable material 100 is bonded around the entire inner circumference of the tubular 102. In the initial condition a passageway 104 remains in the interior of the tubular 102 that may allow fluid or devices to pass.

Figure 5:
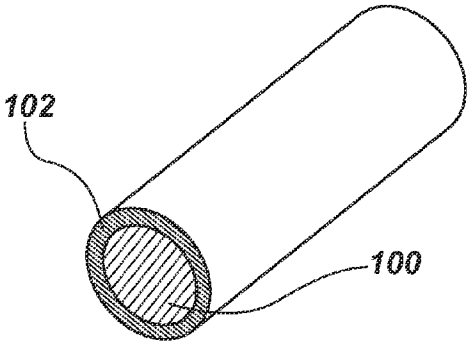
FIG. 5 depicts the swellable material described in FIG. 4 in its second or expanded condition.

FIG. 5 shows the swellable seal or packer described in FIG. 4 in the second or expanded condition. The swellable material 100 that is around the entire inner circumference of the tubular 102 has expanded so the interior portion of the tubular 102 is now completely blocked to fluid or other objects.

Figure 6:
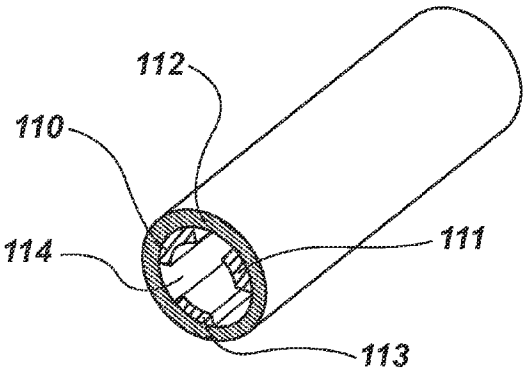
FIG. 6 depicts a swellable seal or packer where multiple pieces of the swellable material are bonded partially around the inner circumference of the tubular.

FIG. 6 depicts a swellable seal or packer where the swellable material 110 is not bonded around the entire inner circumference of the tubular 112. As depicted three pieces of swellable material 110, 111, and 113 are utilized however, various numbers of pieces and percentages of interior coverage are possible. In the initial condition a passageway 114 remains in the interior of the tubular 112 that may allow fluid or devices to pass.

Figure 7:
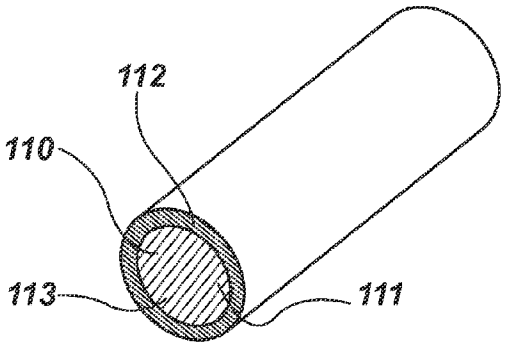
FIG. 7 depicts the multiple pieces of the swellable seal or packer described in FIG. 6 in the second or expanded condition.

FIG. 7 shows the swellable seal or packer described in FIG. 6 in a second or expanded condition. The swellable materials 110, 111, and 113 that are located around the inner circumference of the tubular 102 have expanded so that together they completely block the interior portion of the tubular 112 to fluid or other objects.

It is envisioned that the performance of an inwardly swelling packer or seal could be enhanced through the use of anti-extrusion devices placed at one or both ends of the swelling elastomer. Such an anti-extrusion device could be formed or positioned by the swelling material as the swelling material expanded from a first condition to a second condition.

By incorporating a formable extrusion barrier or anti-extrusion device into the plug, the material comprising the anti-extrusion device could serve to close the central path that the swellable seal or packer is intended to seal. With the central path closed, the swellable material could be contained and thereby becomes less likely to expand to a point at which it loses integrity.

Figure 8:
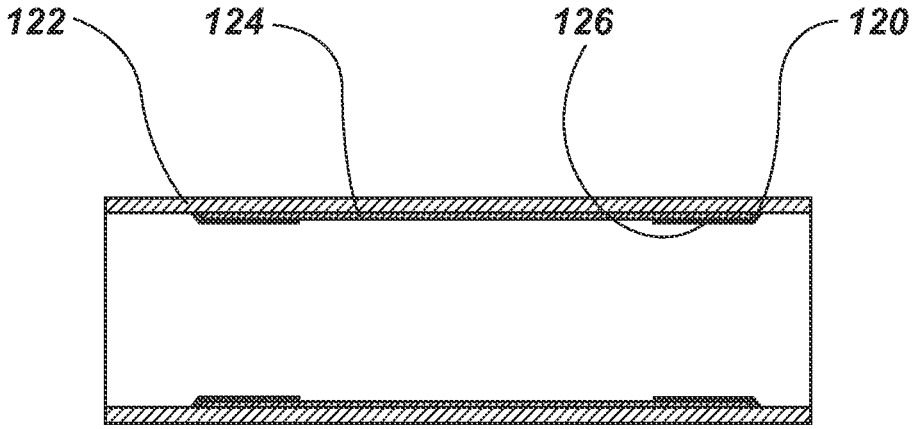
FIG. 8 depicts a swellable material bonded to the interior of the tubular with anti-extrusion devices in place.

As depicted in FIG. 8, in certain embodiments, metallic, plastic, or other durable materials could be formed into circular, cup-like an anti-extrusion devices 120 that may be bonded to the interior of the tubular 122. The anti-extrusion devices 120 may be cut in a number of places creating tabs or petals 126 to allow for easier reshaping of the material as the swellable material 125 expands. These tabs 126 can be cut into specific shapes to facilitate more effective closure of the central passageway.

Figure 10:
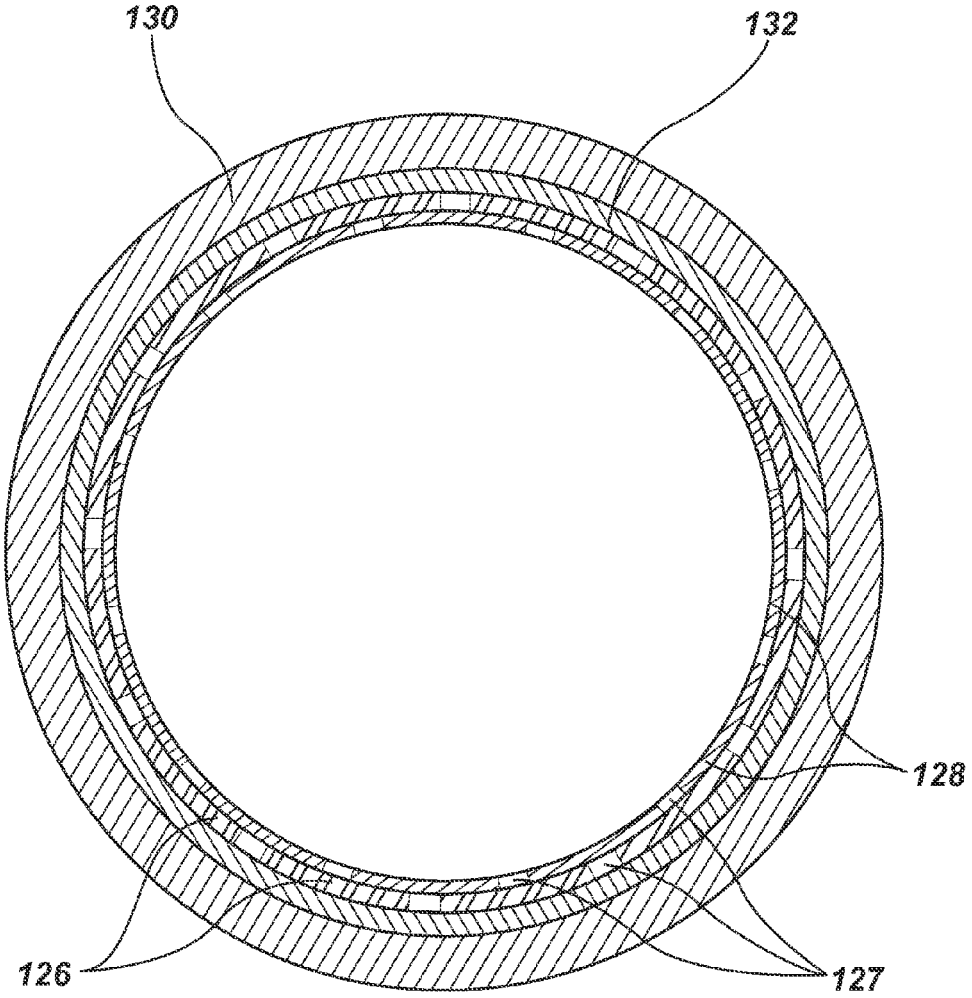
FIG. 10 depicts an anti-extrusion device with multiple layers and overlapping petals.

As depicted in FIG. 10 the tubular 130 has a swellable material 132 bonded to the interior of the tubular. Also bonded to the interior is an anti-extrusion device. The portion of the anti-extrusion device 120 that attaches to the interior of the tubular 130 and is adjacent to the end of the swellable material 132 is not shown so that the overlapping tabs 126 and 128 may be more clearly seen. Multiple layers of tabs 126 and 128 could be used. The layers could be arranged so that the tabs of one layer such as tab 126 would be offset from the tab of another adjacent layer such as 128 providing an overlap between the layers so that the swellable material 125 could be prevented from extruding between the gaps 127 between a single layers tabs as the swellable material 124 expands.

Figure 9:
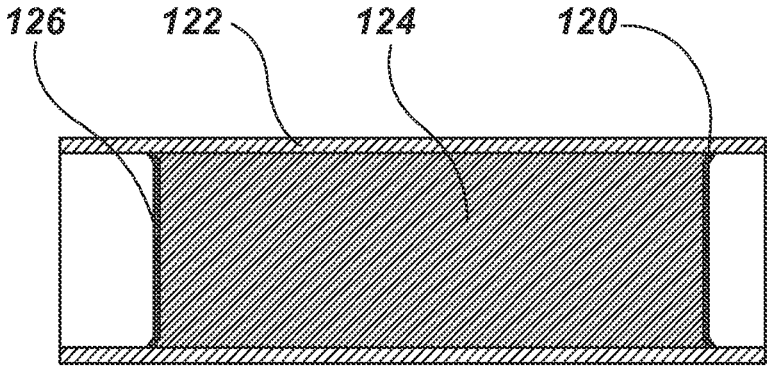
FIG. 9 depicts the anti-extrusion device after the swellable material has expanded such that the tabs are pushed towards the interior of the tubular.

When the swellable material 124 is in the first condition, as depicted in FIG. 8, the tabs 126 are generally parallel to the tubular and overlaps the swellable material 124. As the swellable material 124 expands from its initial condition to its expanded condition, as depicted in FIG. 9, the tabs 126 are pushed towards the interior of the tubular until the tabs 126 are generally perpendicular to the tubular 122.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An apparatus for sealing a wellbore comprising:

a first tubular having an interior; and a sealing element attached to the interior of the first tubular and being substantially formed of a swellable material that is swellable in response to wellbore fluids between a radially inward contracted condition and at least two radially inward expanded conditions; wherein:

in a first radially inward expanded condition the sealing element partially fills the interior of the first tubular and seals against an object an exterior of a second tubular located in the interior of the first tubular and removable therefrom; and in a second radially inward expanded condition the sealing element substantially fills the interior of the first tubular.

2. The apparatus of claim 1 wherein the sealing element is attached substantially completely circumferentially to the interior of the first tubular.

3. The apparatus of claim 1 wherein the sealing element is attached partially about the circumference of the interior of the first tubular.

4. The apparatus of claim 1 wherein the swellable material is an elastomer.

5. The apparatus of claim 1 wherein the elastomer swells in the presence of water.

6. The apparatus of claim 1 wherein the elastomer swells in the presence of hydrocarbons.

7. The apparatus of claim 1 wherein the elastomer swells in the presence of a hybrid fluid.

8. The apparatus of claim 1 wherein:

the sealing element has a first end, a second end, and an interior;

a first support ring attached to the interior of the first tubular at the first end of the sealing element; and a second support ring attached to the interior of the first tubular at the second end of the sealing element.

9. The apparatus of claim 8 wherein the first and second support rings partially overlap the interior of the sealing element.

10. The apparatus of claim 9 wherein the first and second support rings have petals that partially overlap the interior of the sealing element.

11. The apparatus of claim 10 wherein the petals of the first and second support rings have at least two layers that partially overlap the interior of the sealing element.

12. The apparatus of claim 11 wherein the radially inward expanded condition of the sealing element expands the petals of the first and second support rings from a radially inward contracted condition to a radially inward expanded condition.

13. An apparatus for sealing a wellbore comprising:

a tubular having an interior;

a sealing element attached to the interior of the tubular, having a first end, a second end, and an interior;

wherein the sealing element is substantially formed of a swellable material that is swellable in response to wellbore fluids between a radially inward contracted condition and a radially inward expanded condition;

a first support ring attached to the interior of the tubular at the first end of the sealing element; and a second support ring attached to the interior of the tubular at the second end of the sealing element;

wherein the first and second support rings have petals with at least two layers that partially overlap the interior of the sealing element.

14. The apparatus of claim 13, wherein the radially inward expanded condition of the sealing element expands the petals of the first and second support rings from a radially inward contracted condition to a radially inward expanded condition.

15. The apparatus of claim 13, wherein the radially inward expanded condition of the sealing element substantially fills the interior of the tubular.

16. The apparatus of claim 13, wherein the radially inward expanded condition of the sealing element partially fills the interior of the tubular.

17. The apparatus of claim 16 wherein the radially inward expanded condition of the sealing element partially filling the interior of the tubular seals against an object located in the interior of the tubular.

18. The apparatus of claim 13 wherein the sealing element is attached substantially completely circumferentially to the interior of the tubular.

19. The apparatus of claim 13 wherein the sealing element is attached partially about the circumference of the interior of the tubular.

20. The apparatus of claim 13 wherein the swellable material is an elastomer.

21. The apparatus of claim 13 wherein the elastomer swells in the presence of water.

22. The apparatus of claim 13 wherein the elastomer swells in the presence of hydrocarbons.

23. The apparatus of claim 13 wherein the elastomer swells in the presence of a hybrid fluid.

24. A method of sealing a wellbore, the method comprising:

running into a wellbore a first tubular having an interior and a sealing element attached to the interior, the sealing element being substantially formed of a swellable material that is swellable in response to wellbore fluids between a radially inward contracted condition and at least two radially inward expanded conditions;

running a second tubular into the wellbore, the second tubular being located inside the first tubular and extending past the sealing element;

allowing the swellable material to expand to a first radially inward expanded condition partially filling the interior of the first tubular and sealing against the second tubular;

performing an operation in the wellbore;

withdrawing the second tubular; and allowing the swellable material to expand to a second radially inward expanded condition substantially filling the interior of the first tubular.

* * * * *